US005402984A

United States Patent [19]

Crockett, IV et al.

[11] Patent Number: 5,402,984

[45] Date of Patent: Apr. 4, 1995

[54] JACK MECHANISM HAVING POSITIVE STOP MEANS FOR ITS CRANK HANDLE

[75] Inventors: Watkins Crockett, IV, Franklin, Tenn.; Bernard W. Baird, Avenue, Md.

[73] Assignee: The United States of America as represented by the Secretary of the Navy, Washington, D.C.

[21] Appl. No.: 183,707

[22] Filed: Jan. 18, 1994

[51] Int. Cl.[6] ..... B66F 3/08

[52] U.S. Cl. ..... 254/98; 192/141; 74/526; 74/545

[58] Field of Search ..... 192/141; 74/526, 545, 74/528, 532; 254/98, 100, 103, 423, 424, DIG. 2, 126

[56] References Cited

U.S. PATENT DOCUMENTS

| | | | |
|---|---|---|---|
| 1,997,444 | 4/1935 | Wilson | 192/141 |
| 2,951,460 | 9/1960 | Pierson | 192/141 |
| 4,396,813 | 8/1983 | Hesselbart et al. | 192/141 |
| 5,230,416 | 7/1993 | Itoh et al. | 192/141 |

*Primary Examiner*—Robert C. Watson

*Attorney, Agent, or Firm*—James V. Tura; Susan E. Verona

[57] ABSTRACT

A jack mechanism having a crank handle that drives a linear motion control ball nut and threaded screw. Two rods are included to provide a positive stop in each direction of the jack's limit so as to prevent overrun of the mechanism.

7 Claims, 2 Drawing Sheets

JACK MECHANISM HAVING POSITIVE STOP MEANS FOR ITS CRANK HANDLE

The invention described herein, may be manufactured and used by and for the Government of the United States of America for governmental purposes without the payment of any royalty thereon or therefore.

BACKGROUND OF THE INVENTION

The present invention relates to a jack mechanism and, more particularly, to a jack mechanism having two parallel rods that provide positive stops, in each direction, for the rotation of the jack handle so as to prevent overrun of the jack mechanism.

Jack mechanisms are well known and provide a means for exerting a pressure for the lifting of a relatively heavy object for a relatively short distance. The jack mechanism almost always has a lever arm or crank handle attached thereto that provides the operator with a mechanical advantage for turning the shaft of the jack mechanism that is interlinked to the object being lifted. Commonly, the lever arm or crank handle is attached to the mechanism by a pin or key inserted into a complementary keyway of the jack mechanism. The crank handle allows for circular motion to be imparted to the shaft lifting the object so that reciprocating motion, e.g., up-down, or inward-outward movement, is achieved. The operator of the jack mechanism sometimes, due to his/her desire to have the heavy object moved, may inadvertently exert a sufficient force on the crank handle, after the shaft of the jack mechanism has reached an extreme of its movement, to cause a twisting motion to be supplied at a sufficient magnitude to cause the pin of the crank handle to be rung off of the keyway. It is desired that means be provided to prevent the inadvertent severance of the crank handle when the shaft of the jack mechanism has reached either of its extremes of reciprocating movement.

SUMMARY OF THE INVENTION

The present invention is directed to a jack mechanism having two parallel rods that are interconnected with the mechanism to prevent the crank handle and shaft both of the jack mechanism, from going beyond predetermined limits.

The invention is particularly suited to provide positive stops for predetermined limits of the clockwise and counterclockwise circular rotation of a crank handle of the jack mechanism which, in turn, prevents the shaft of the jack mechanism from going past or overrunning its predetermined limits. The jack mechanism comprises a threaded screw, a control ball nut, a ball screw, a series of linkages, a crank handle, and stop means for limiting the rotation of the crank handle at crank positions corresponding to "fully-opened" and "fully-closed" positions of the jack mechanism. The screw has a main body with respective ends and has a predetermined number of threads with each thread having a predetermined lead. The control ball nut is arranged to be linearly moved, in a reciprocating manner, along the main body of the screw in both a first and a second direction each having a defined extent and at a rate determined by the predetermined lead. The ball screw is rigidly affixed, has means for being arranged to engage one end of the threaded screw, and is capable of causing both clockwise and counterclockwise rotation of the thread screw so that the control ball nut is respectively moved in its first and second directions. The series of linkages are rigidly affixed to the other end of the threaded screw and are capable of exerting a pressure to cause the lifting of a relatively heavy object when the screw is rotated in one direction, e.g., clockwise, and are capable of relieving the exerting pressure when the screw is rotated in another direction, e.g., counterclockwise. The crank handle is interconnected to and is capable of imparting clockwise and counterclockwise motion to the threaded screw which, in turn, causes the control ball nut to be moved in its first and second directions. The stop means comprises first and second rods, a sleeve means, a pivot bar, and first, second and third pins. The first and second rods each having a predetermined length are arranged parallel to each other. The sleeve means surrounds and has a hollow to allow one of the rods to move therein and also has means for being rigidly affixed to the control ball nut. The pivot bar has a central portion and first and second end regions each having an elongated opening. The first and second pins respectively connect the first and second ends regions of the pivot bar to the first and second parallel rods. The third pin connects the central portion of the pivot bar to a fixed member in a stationary, but pivotal manner. In operation, the combination of the pivot bar and the sleeve means connected to the control ball nut, causes the first and second rods to be respectively moved in the first and second directions of the control ball nut and at a rate corresponding to the rate of the movement of the control ball nut. The first and second rods have their respective predetermined length selected so that each of the first and second rods respectively move, in a reciprocating manner, in the first and second directions by a distance which exceeds the defined extent of the first and second directions of the movement of the control ball nut. This exceeding movement causes the first and second rods to intercept and absorb the affects of any torque applied to the crank handle when, or very nearly before, the control ball nut has reached either of its defined extents of movement.

Accordingly, it is an object of the present invention to provide stop means having two reciprocating rods that prevent the crank handle from allowing the control ball nut of the jack mechanism to exceed its predetermined limits and does so without allowing any torque applied to the crank handle from severing the crank handle from the jack mechanism.

Another object of the present invention is to provide means that reduces the mechanical friction that may occur during the movement of the pivot bar of the stop means of the present invention.

A further object of the present invention is to provide stop means for limiting the circular rotation of the crank handle so that the movement of both the crank handle and the control ball nut terminate simultaneously.

Other objects, advantages and novel features will become apparent from the following detailed description when considered in conjunction with the accompanying drawings.

DETAILED DESCRIPTION OF THE PREFERRED EMBODIMENTS

Figure 1:
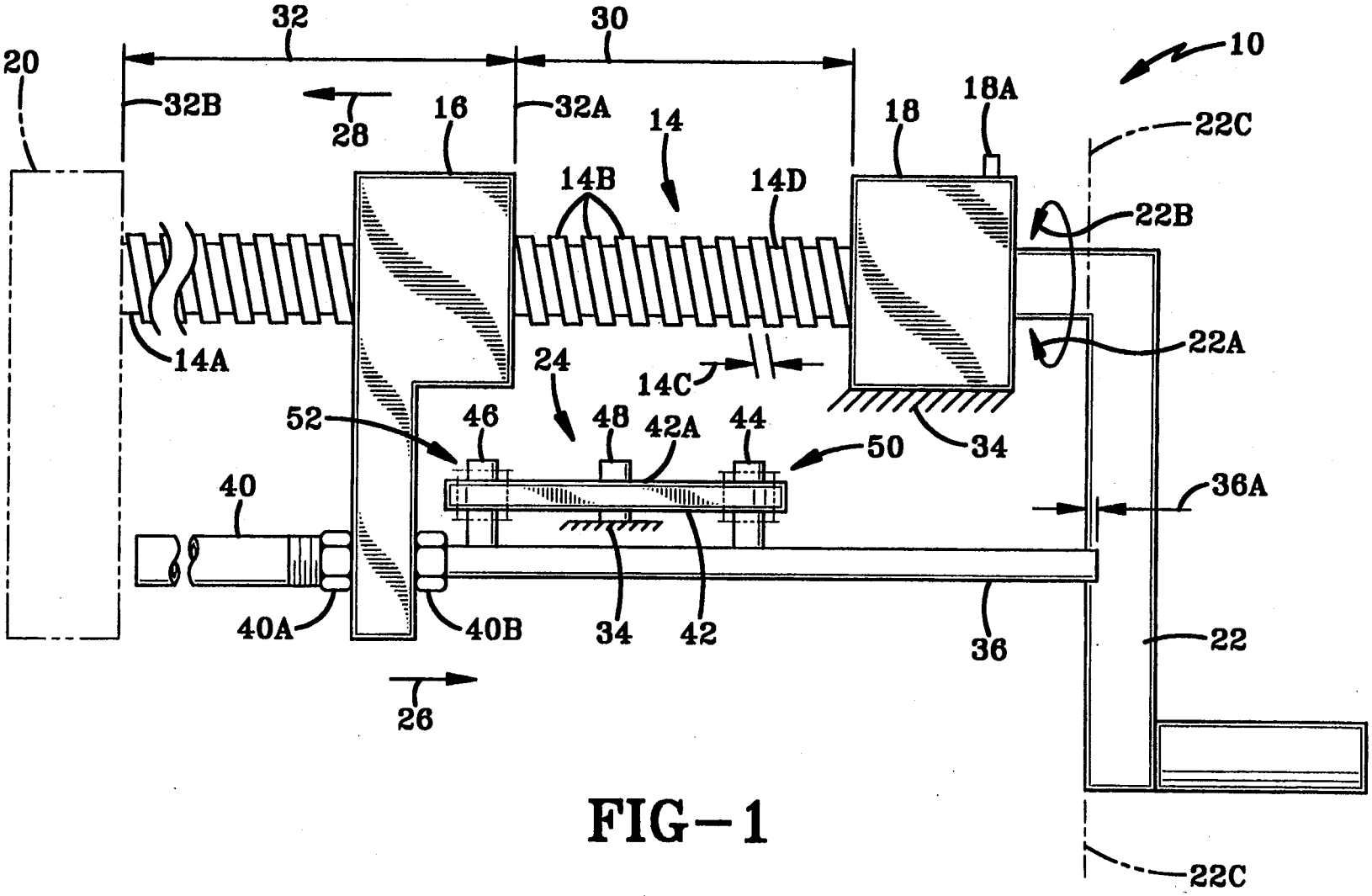
FIG. 1 is a schematic illustrating the jack mechanism of the present invention in its "fully-opened" position.

Referring to the drawings, wherein like reference numbers indicate like elements, FIG. 1 is a schematic illustrating a jack mechanism 10, in its "fully-opened" position, that is capable of exerting a pressure to cause the lifting of a relatively heavy object 12 (not shown) for a relatively short distance. The jack mechanism 10 of the present invention comprises a threaded screw 14, a control ball nut 16, a ball screw 18, a series of linkages 20, a crank handle 22, and a stop means 24.

In general, the jack mechanism 10 provides the threaded screw 14 and control ball nut 16 to assist in the lifting operation through a series of linkages, generally shown, in phantom, by reference number 20. The crank handle 22, in cooperation with the ball screw 18, is used to drive the control ball nut 16 in a linear and reciprocating manner along the threaded screw 14. As is known in the art, the control ball nut 16 travels along the screw 14, and drives the associated series of linkages 20 in such a manner so as to provide a lifting operation. More particularly, as is also known in the art, the series of linkages 20 have an output member which is placed in contact with the load to be lifted and served as a mechanical member that delivers the lifting force developed by the jack mechanism 10. The series of linkages 20 are rigidly coupled and affixed to one end, such as 14A, of the threaded screw 14 and are capable of exerting a pressure that causes the lifting of a relatively heavy object when the screw 14 is rotated in one direction, e.g., clockwise, and relieves the exerting pressure when the screw 14 is rotated in the other direction, e.g., counterclockwise. The clockwise rotation of the threaded screw 14 causes the control ball nut 16 to move in a first or, as viewed in FIG. 1, inward direction 26, and, conversely, the counterclockwise rotation of the threaded screw 14 causes the control ball nut 16 to move in a second or, as viewed in FIG. 1, outward direction 28.

The threaded screw 14 has a main body with a predetermined length which includes distances 30 and 32, wherein the distance 30 is the spacing between the control ball nut 16 and the ball screw 18 when the jack mechanism is in its "fully-opened" position, and the distance 32 corresponds to the remainder of the length of the screw 14. The threaded screw 14 also has a predetermined number of threads 14B, with each thread having a predetermined lead 14C. The lead 14C corresponds to the amount of axial advance of a point accompanying a complete turn of a thread 14B. The threaded screw 14 has its other end 14D engaged to the ball screw 18.

The control ball nut 16 is arranged to be linearly moved along the main body of the threaded screw 14 in a reciprocating manner in both the first 26, and second 28 directions at a rate determined by the predetermined lead 14C. The control ball nut 16 has defined extents 32A and 32B, shown in FIG. 1, corresponding to the maximum outward movement in direction 26 and the maximum inward movement 28 respectively. The maximum outward movement (extent 32A) corresponds to the "fully-opened" position of the jack mechanism 10, whereas the maximum inward movement (extent 32B) corresponds to the "fully-closed" position of the jack mechanism 10.

The ball screw 18 is rigidly and, in a stationary manner, fixed to a frame member 34. The ball screw 18 has appropriate means, such as a ratchet mechanism, that is arranged to engage the end 14D of the threaded screw and is capable of causing clockwise and counterclockwise rotation of the threaded screw 14 so that the control ball nut 16 is respectively moved in the first and second directions 26 and 28, respectively.

The crank handle 22 is rotatable in a clockwise direction 22A and in a counterclockwise direction 22B and, further, is interconnected to the threaded screw 14 by appropriate means, such as the previously mentioned ratchet mechanism. The crank handle 22 has an inward (as viewed from FIG. 1) plane of rotation shown by dimension line 22C and in its operation imparts clockwise and counterclockwise movement to the threaded screw 14 which, in turn, causes the outward and inward movements 26 and 28, respectively, of the control ball nut 16.

The stop means 24 limits the rotation of the crank handle 22 at crank positions corresponding to "fully-opened," shown in FIG. 1, and to "fully-closed" (not shown) positions. The stop means 24 comprises a first rod 36 and a second rod 38 (not shown in FIG. 1, but shown in FIG. 2), sleeve means 40, a pivot bar 42, and first, second, and third pins 44, 46 and 48, respectively. If desired, the stop means 24 may further comprise friction reducing assemblies 50 and 52, each comprising a washer and flat bearing interposed respectively between pins 44 and 46 and the common pivot bar 42. The assemblies 50 and 52 more readily allow for the movement of pins 44 and 46, respectively, within the pivot bar 42 (to be further described) and thereby act as friction reducing means. Further details of the stop means 24 may be further described with reference to FIG. 2.

Figure 2:
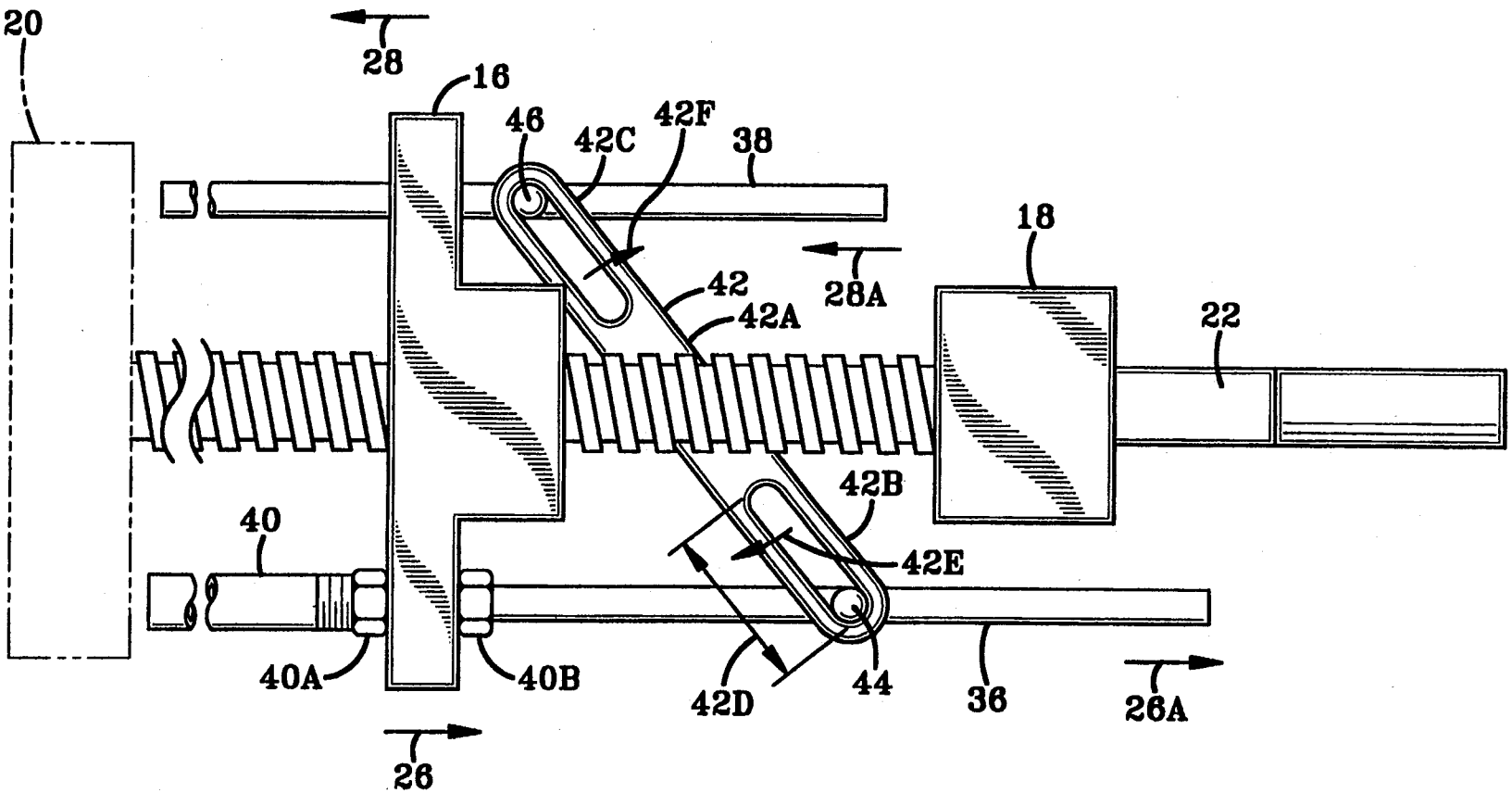
FIG. 2 is a schematic illustrating further details of the stop means of the jack mechanism of FIG. 1.

FIG. 2 illustrates the jack mechanism 10 at a different view from that of FIG. 1. More particularly, FIG. 1 may be a side view of jack mechanism 10 so that FIG. 2 may serve as a top view thereof. The views of FIGS. 1 and 2 may be interchanged dependent upon the configuration that the jack mechanism 10 is arranged to accomplish desired lifting. FIG. 2 illustrates the first and second rods 36 and 38 being arranged in a parallel manner, wherein the first rod 36 serves as the outboard rod and the second rod 38 serves as an inboard rod. Each of the rods 36 and 38 has a predetermined length and the outboard rod 36 is preferably connected to a sleeve means 40, although inboard rod 38 may be alternately connected to the sleeve means 40 and similar results (to be described) will be obtained.

Sleeve means 40 has a hollow (not shown), and is arranged to surround the outboard rod 36, so as to allow the outboard rod 36 to move therein. Sleeve means 40 has appropriate means, such as nuts 40A and 40B, so that it may be rigidly affixed to the control ball nut 16. Conversely, as shown in FIG. 2, there is no interconnection between the inboard rod 38 and the control ball nut 16, but rather, as to be described, the inboard rod 38 is caused to move by the pivoting action of the pivotal bar 42. The rigidly attached sleeve 40 causes the outboard rod 36, by means of pin 44, to move in unison with the control ball nut 16. Further, the outboard rod 36 moves, from its innermost location (not shown) to its outermost location shown in FIG. 1, in a direction 26A that corresponds to the direction 26 of the control ball nut 16, whereas the inboard rod 38 moves, from its innermost location shown in FIG. 1 to its outermost location (not shown), in a direction 28A that corresponds to the direction 28 of the control ball nut 16.

The common pivot bar 42 has a central region 42A (shown in FIG. 1) that is connected in a stationary but pivotable manner to the frame 34 by means of the pin 48. The common pivot bar 42 further comprises first and second regions 42B and 42C, most clearly shown in FIG. 2. It should be noted that the friction reducing means 50 and 52 of FIG. 1 are not shown in FIG. 2 so as to more clearly expose regions 42B and 42C. Each of the regions 42B and 42C has an elongated opening having a length 42D (only shown for region 42C) that is preferably about one-half of the distance 30 shown in FIG. 1 so that their respective pins may move therein while the pivot bar 42 is being rotated, in a manner to be described. As will be further described, and as shown in FIG. 2, pivot bar 42 is rotatable in a clockwise direction, as shown by arrow 42E, and in a counterclockwise direction, as shown by arrow 42F. The first and second pins 44 and 46 respectively connect the first and second end regions 42B and 42C to the parallel rods 36 and 38.

OPERATION OF THE STOP MEANS

In general, the combination of the sleeve means 40 and the pivot bar 42 causes the first and second rods 36 and 38 to be respectively moved in the first 26A and second 28A directions, respectively, as the control ball nut 16 is linearly moved inward (direction 26) and outward (direction 28), in a reciprocating manner, by the rotation of the crank handle 22. The first and second rods 36 and 38 are moved in unison with and at a rate corresponding to the rate of movement of the control ball nut 16. The first and second rods 36 and 38 have their respective predetermined lengths selected so that each of the first and second rods 36 and 38 respectively move in the first and second directions 26A and 28A by an amount, relatively to the crank handle 22, which exceeds the movement defined by extents 32A and 32B respectively of the control ball nut 16. More particularly, the distance of the movement covered by either of rods 36 or 38 exceeds the distance 32 which is the maximum distance in which the control ball nut 16 may be moved inward (direction 26) from extent 32A to extent 32B, or outward (direction 28) from extent 32B to extent 32A.

The jack mechanism 10 is shown in FIG. 1 in its fully-opened position, wherein the outboard rod 36 has a portion 36A that protrudes into the plane 22C of rotation of the crank handle 22. The protruding portion 36A of the outboard rod 36 provides a positive stop to prevent the handle 22 from advancing any further in clockwise direction 22B. The protruding portion 36A comes into contact with the crank handle after the crank handle has been rotated in a clockwise direction so that the control ball nut 16 has advanced far enough so that it has obtained a position corresponding to that of the outward extent 32A. Concurrently with the movement of the control ball nut 16, the outboard rod 36 is moved outward until its protruding portion 36A contacts the crank handle 22 simultaneously, or very nearly, as the control ball nut 16 reaches a position corresponding to that of the outward extent 32A. When the crank handle 22 contacts protruding portion 36A (or protruding portion 38A to be described), the protruding portion 36 along with remainder of rod 36 (or remainder of rod 38) provides a positive stop and absorbs the affects of any impact in such a manner so that, unlike the crank handle discussed in the "Background" section, the crank handle 22 remains affixed to the jack mechanism 10, in particular, to the ball screw 18. To remove this positive stop (protrusion 36A), all that is necessary is to initiate a counterclockwise rotation of the handle 22 which results in the retraction of the protruding portion 36A out of the plane 22C of rotation and also initiates the advancement of the inboard rod 38 toward the plane 22C of rotation 22C. If desired, a safety handle 18A (generally shown in FIG. 1) may be provided that requires its depression before the crank handle 22 is allowed to disengage from the protruding portion 36A. The operation of the stop means 24 may be further described with reference to FIG. 2.

As the handle 22 is further rotated in counterclockwise direction, and assuming (if applicable) the safety handle 18A is depressed, the protruding portion 36A begins to retract through the sleeve 40 at a rate equal to the lead of the screw. More particularly, preferably, one rotation of the crank handle 22 in a counterclockwise direction causes the protruding portion 36A to retract completely out of the plane 22C of rotation and allows the crank handle 22 to thereby pass. Likewise, as the protruding portion 36A retracts it forces the slotted pivotal bar 42 to rotate in a clockwise direction, shown by arrow 42E. More particularly, as the outboard rod 36 retracts in a direction opposite to directions 26 and 26A it causes its pin 44 to force against region 42B and, thereby, causes the rotation (42E) of the pivot bar 42. As the pivot bar 42 rotates (42E), it in turn forces the inboard rod 38 to advance in an opposite direction toward the plane 22C of rotation of the handle 22. More particularly, the clockwise rotation of region 42B causes the clockwise rotation of region 42C which, in turn, carries or pulls along with it the inboard rod 38 and in a direction opposite to that of directions 28 and 28A. As the inboard rod 38 approaches the crank handle 22, it moves at a rate equal to the lead of the threaded screw 14, and this in conjunction with the selection of the appropriate length of the rod 38 ensures that the rod 38 will intercept the crank handle 22 only after a predetermined number of turns of the screw 14. More particularly, the length of the rod 38 that is selected such that it will extend into the plane 22C of rotation, by an amount similar to the protruding portion 38A, when the control ball nut 16 has been moved to its extent 32B. The description of the selection of the length for inboard rod 38 is equally applicable to that of the outboard rod 36.

It should now be appreciated that the practice of the present invention provides for a stop mechanism 24 having parallel arranged rods 36 and 38, which intercept the clockwise and counterclockwise rotation of the crank handle 22 at predetermined limits, so that these rods 36 and 38 absorb any possible torque undesirably applied to the crank handle, after control ball nut 16 has reached its predetermined limits of reciprocating movement. The absorption of these rods 36 and 38 eliminates the problem, discussed in the "Background" section, of the crank handle from being inadvertently severed from the jack mechanism.

Although the invention has been described relative to a specific embodiment thereof, it is not so limited and many modifications and variations thereof now will be readily apparent for those skilled in the art in light of the above teaching.

What we claim is:

1. A jack mechanism for causing the lifting of a an object comprising:

(a) a threaded screw having a predetermined number of threads with each thread having a predetermined lead, said threaded screw having a main body with first and second respective ends and one of which ends being mechanically coupled to said object;

(b) a control ball nut arranged to be linearly moved along said main body of said threaded screw in both a first and a second direction with each direction having a defined extent and at a rate determined by said predetermined lead;

(c) a ball screw rigidly affixed and having means for being arranged to engage the other end of said threaded screw and being capable of causing both clockwise and counterclockwise rotation of said screw so that said control ball nut is respectively moved in said first and second directions;

(d) a crank handle interconnected to said ball screw, said crank handle capable of imparting both clockwise and counterclockwise rotation of said threaded screw which, in turn, imparts said linear movement of said control ball nut; and (e) stop means for limiting rotation of said crank handle at predetermined limits that correspond to "fully-opened" and "fully-closed" positions of said jack mechanism, said stop means comprising:

(i) first and second rods arranged parallel to each other and each having a predetermined length;

(ii) sleeve means surrounding and having a hollow to allow one of said rods to move therein and having means for being rigidly affixed to said control ball nut;

(iii) a pivot bar having a central portion, and first and second end regions each having an elongated opening; and (iv) first, second and third pins for respectively connecting said first and second end regions to said first and second parallel rods, one of said first and second parallel rods being further confined in its movement by its respective end region as well as by said hollow while the movement of the other one of said rods is confined by its respective end region, said third pin connecting said central portion to a fixed member in a stationary but pivotal manner;

wherein the combination of said pivot bar and said sleeve means connected to said control ball nut causes said first and second rods to be respectively moved in said first and second directions of said control ball nut and at a rate corresponding to said rate of movement of said control ball nut, said first and second rods having their respective predetermined lengths selected so that said first and second rods respectively move in said first and second directions by an amount which respectively exceeds said defined extents of said first and second directions of movement of said control ball nut.

2. The jack mechanism of claim 1, wherein said first and second rods have their respective lengths selected so that the distance that their movement exceeds said movement of said control ball nut is of an amount corresponding to said lead of said threaded screw.

3. The jack mechanism according to claim 1, wherein said control ball nut is spaced apart from said ball screw by a first predetermined distance when said control ball nut is moved in its first direction to one of its defined extent, and wherein each of said elongated openings of said pivot bar has a length that corresponds to approximately at least one-half of said first predetermined distance.

4. Means for providing stops for a crank handle which cooperates with a threaded screw of a jack that exerts a pressure to cause lifting of an object, said stop means comprising:

(a) first and second rods arranged parallel to each other and each having a predetermined length;

(b) sleeve means surrounding and having a hollow to allow one of said rods to move therein, and having means for being rigidly affixed to a movable member that is linearly moved along a threaded screw with a predetermined number of threads and with each thread having a predetermined lead, said threaded screw being moved in one direction when said pressure is exerted to lift said relatively heavy object and in an opposite direction when said lifting pressure is being relieved;

(c) a pivot bar having a central portion and first and second regions each having an elongated opening; and (d) first, second and third pins for respectively connecting said first and second end regions to said first and second parallel rods, one of said first and second parallel rods being further confined in its movement by is respective end region as well as by said hollow while the movement of the other one of said rods is confined by its respective end region, said third pin connecting said central portion to a fixed member in a stationary but pivotal manner.

5. The stop means according to claim 4, wherein said first and second rods have their respective predetermined lengths selected so that the distance of their movement exceeds said movement of said movable member by an amount corresponding to said lead of said threaded screw.

6. The stop means according to claim 4, wherein said elongated opening of said pivot bar has a length that corresponds to about at least one-half of a distance that said movable member is selected to be moved.

7. A jack mechanism for causing the lifting of a relatively heavy object comprising:

(a) a threaded screw having a predetermined number of threads with each thread having a predetermined lead, said screw having a main body with first and second respective ends and one of which ends being mechanically coupled to said object;

(b) a control ball nut arranged to be linearly moved along said main body of said threaded screw in both a first and a second direction with each direction having a defined extent and at a rate determined by said predetermined lead;

(c) a ball screw rigidly affixed and having ratchet means for engaging the other end of said threaded screw and being capable of causing both clockwise and counterclockwise rotation of said threaded screw so that said control ball nut is respectively moved in said first and second directions;

(d) a crank handle interconnected to said ball screw by said ratchet means and capable of imparting both clockwise and counterclockwise rotation of said threaded screw which, in turn, causes said control ball nut to be moved in said first and second directions; and (e) stop means for limiting rotation of said crank handle at predetermined limits that correspond to "fully-opened" and "fully-closed" positions of said jack mechanism, said stop means comprising:

(i) first and second rods arranged parallel to each other and each having a predetermined length;

(ii) sleeve means surrounding and having a hollow to allow one of said rods to move therein and having means for being rigidly affixed to said control ball nut;

(iii) a pivot bar having a central portion, and first and second end regions each having an elongated opening; and (iv) first, second and third ends for respectively connecting said first and second end regions to said first and second parallel rods, one of said first and second parallel rods being further confined in its movement by its respective end region as well as by said hollow while the movement of the other one of said rods is confined by its respective end region, said third pin connecting said central portion to a fixed member in a stationary but pivotal manner;

wherein the combination of said pivot bar and said sleeve means connected to said control ball nut causes said first and second rods to be respectively moved in said first and second directions of said control ball nut and at a rate corresponding to said rate of movement of said control ball nut, said first and second rods having their respective predetermined lengths selected so that said first and second rods respectively move in said first and second directions by an amount which respectively exceeds said defined extents of said first and second directions of movement of said control ball nut.

* * * * *